US005409661A

United States Patent [19]

Imahashi et al.

[11] Patent Number: 5,409,661

[45] Date of Patent: Apr. 25, 1995

[54] ALUMINUM ALLOY

[75] Inventors: Kunihiko Imahashi, Aichi; Hirohisa Miura, Okazaki; Yasuhiro Yamada, Tajimi; Hirohumi Michioka, Toyota; Jun Kusui, Youkaichi; Akiei Tanaka, Ohmihachiman, all of Japan

[73] Assignees: Toyota Jidosha Kabushiki Kaisha, Aichen; Toyo Aluminium Kabushiki Kaisha, Osaka, both of Japan

[21] Appl. No.: 248,546

[22] Filed: May 24, 1994

Related U.S. Application Data

[63] Continuation of Ser. No. 963,477, Oct. 21, 1992, abandoned.

[30] Foreign Application Priority Data

Oct. 22, 1991 [JP] Japan ..... 3-303964
Sep. 25, 1992 [JP] Japan ..... 4-280543

[51] Int. Cl.[6] ..... B22F 3/00; C22C 21/04

[52] U.S. Cl. ..... 419/10; 75/232; 420/537; 420/538

[58] Field of Search ..... 75/232, 249; 148/415; 419/11, 23, 67; 420/538, 548, 528, 537; 428/408

[56] References Cited

U.S. PATENT DOCUMENTS

| | | | |
|---|---|---|---|
| 3,885,959 | 5/1975 | Badia et al. | 75/138 |
| 4,702,885 | 10/1987 | Odani et al. | 419/23 |
| 4,722,751 | 2/1988 | Akechi et al. | 75/232 |
| 4,943,413 | 7/1990 | Tank | 420/528 |
| 4,946,500 | 8/1990 | Zedalis et al. | 75/232 |
| 4,975,243 | 12/1990 | Scott et al. | 420/534 |
| 5,169,718 | 12/1992 | Miura et al. | 428/408 |

FOREIGN PATENT DOCUMENTS

| | | |
|---|---|---|
| 0100470 | 2/1984 | European Pat. Off. . |
| 0147769 | 7/1985 | European Pat. Off. . |
| 0196369 | 8/1986 | European Pat. Off. . |
| 0196984 | 10/1986 | European Pat. Off. . |
| 0363225 | 4/1990 | European Pat. Off. . |
| 0363225 | 4/1990 | European Pat. Off. . |
| 0366134 | 5/1990 | European Pat. Off. . |
| 0539172A1 | 4/1993 | European Pat. Off. . |
| 0561204A2 | 9/1993 | European Pat. Off. . |
| 59-13040 | 1/1984 | Japan . |
| 59-59855 | 4/1984 | Japan . |
| 60-50138 | 3/1985 | Japan . |
| 60-159137 | 8/1985 | Japan . |
| 64-56844 | 3/1989 | Japan . |
| 1-177340 | 7/1989 | Japan . |
| 1-272741 | 10/1989 | Japan . |
| 2-129338 | 5/1990 | Japan . |
| 2-149631 | 6/1990 | Japan . |
| 2-149632 | 6/1990 | Japan . |
| 2-149633 | 6/1990 | Japan . |
| 2-56401 | 11/1990 | Japan . |
| 3-291348 | 12/1991 | Japan . |
| 4-105787 | 4/1992 | Japan . |
| 4-173935 | 6/1992 | Japan . |
| 4-176836 | 6/1992 | Japan . |
| 4-202736 | 7/1992 | Japan . |
| 4-202737 | 7/1992 | Japan . |
| 4-311545 | 11/1992 | Japan . |
| 4-323343 | 11/1992 | Japan . |
| 4-323343 | 11/1992 | Japan . |
| 5-5146 | 1/1993 | Japan . |
| 5-5147 | 1/1993 | Japan . |

OTHER PUBLICATIONS

Aluminum Alloy Metallurgy Symposium.
Chemical Abstracts, vol. 113, 1990, No. 116, 15 Oct. 1990. and JP-A-1 263 244, 19 Oct. 1989.
European Search Report.
Statement of Relevancy for JP1-247546.
Statement of Relevancy for JP60-159137.

*Primary Examiner*—Donald P. Walsh
*Assistant Examiner*—John N. Greaves
*Attorney, Agent, or Firm*—Finnegan, Henderson, Farabow, Garrett & Dunner

[57] ABSTRACT

An aluminum alloy consists essentially of 90 to 99.5% by weight of matrix and 0.5 to 10% by weight of a dispersant dispersed within the matrix. The matrix comprises 10 to 25% by weight of Si, 5 to 20% by weight of Ni, 1 to 5% by weight of Cu and the rest of Al and impurity elements. The dispersant is at least one selected from the group consisting of 0.5 to 10% of nitride, boride, carbide and oxide. The aluminum alloy shows excellent tensile strength and wear resistance.

11 Claims, 7 Drawing Sheets

X-ray Diffraction Result of Al-15Ni-15Si-3Cu

ALUMINUM ALLOY

This application is a continuation, of application Ser. No. 07/963,477, filed Oct. 21, 1992, now abandoned.

BACKGROUND OF THE INVENTION

1. Field of the Invention

The present invention relates to an aluminum alloy which shows low friction characteristics. It is suitable for use as engine components of automobiles and is excellent in both tensile strength and wear resistance.

2. Description of the Related Art

An aluminum alloy has light weight and excellent processability. So it has been conventionally used as structural materials of air planes and automobiles. Recently, an engine of automobiles comes to require high power and low fuel consumption. In accordance with this requirement, the aluminum alloy is being applied for rocker arms, shift forks and engine components such as piston or cylinder head. So, the aluminum alloy is improved in its wear resistance and tensile strength.

Al-based composite materials having excellent wear resistance and excellent stiffness include, for example, a high tensile aluminum alloy material. It is produced by powder metallurgy in which particles, whiskers and fibers of SiC or $Al_2O_3$ are added into Al—Cu—Mg alloy (2000 series) or Al—Mg—Bi alloy (6000 series).

A high tensile aluminum alloy powder having excellent tensile strength, excellent wear resistance and low thermal expansion is developed (See Japanese Patent Publication No. 56401/1990). The method for producing the high tensile aluminum alloy powder is that 7.7 to 15% of Ni is added to an Al—Si alloy, then Cu and Mg are added. Concerning the obtained high tensile aluminum alloy powder, the size of primary Si is less than 15 μm.

Regarding piston, a skirt portion requires excellent wear resistance, excellent heat conductivity, low thermal expansion and excellent tensile strength. Cylinder liner requires excellent wear resistance, excellent antiseize and low friction coefficient.

The above alloy such as 2000 series alloy or 6000 series alloy is used as matrix, and particles, whiskers and fibers of SiC or $Al_2O_3$ are added into the matrix, thereby obtaining Al-based Metal Matrix Composites (hereinafter described as MMC). It shows poor tensile strength because the matrix itself shows poor tensile strength.

When the above Al-based MMC is used as a sliding member of the above piston or the above cylinder liner, the temperature of a sliding portion rises. So, agglutination abrasion or abrasive friction generates, and friction coefficient becomes high and abrasion loss becomes large. Therefore, to use the Al-based MMC as the sliding member is restricted not only at high temperature but also room temperature.

The above high tensile aluminum alloy in which Ni is added into an Al—Si alloy shows excellent tensile strength because stable Al—Ni intermetallic compounds are formed. When the high tensile aluminum alloy is used as a sliding member, it shows poor wear resistance since hard particles such as ceramics are not included. Concerning sliding characteristics, Al is adhered to the mating member because of agglutination. The high tensile aluminum alloy cannot be improved in its friction coefficient, seize load and abrasion loss. Therefore, the high tensile aluminum alloy is used as the sliding member only for the restricted area under the restricted condition.

When the conventional aluminum alloy is used as the sliding member of the engine component, it shows poor tensile strength and poor sliding characteristics.

SUMMARY OF THE INVENTION

Concerning the above problems, it is an object of the present invention to provide an aluminum alloy which shows excellent tensile strength and excellent sliding characteristics (i.e. excellent wear resistance and excellent antiseize in spite of low friction).

Inventors examined a base composition for the purpose of obtaining tensile strength and wear resistance of the matrix. As the result, we happened to think that wear resistance is obtained by precipitating primary Si crystal within the range of hyper-eutectic of an Al—Si alloy. Similarly, we also happened to think that tensile strength is obtained by adding Ni and Cu.

Concerning the above matrix, inventors further studied a dispersant for the purpose of improving sliding characteristics. As the result, we found the following facts. When nitride is dispersed, Al is not adhered to the mating member, and wear resistance and antiseize are obtained with low friction coefficient. When boride is dispersed, fluid lubrication of $B_2O_3$ occurs, and wear resistance and antiseize are obtained in spite of low friction coefficient. When oxide or carbide is dispersed, wear resistance improves. Therefore, inventors completed the present invention.

An aluminum alloy according to the present invention is excellent in its tensile strength and wear resistance. The aluminum alloy consists essentially of 90 to 99.5% by weight of matrix and 0.5 to 10% by weight of a dispersant dispersed within the matrix. The matrix comprises 10 to 25% by weight of Si, 5 to 20% by weight of Ni, 1 to 5% by weight of Cu and the rest of Al and impurity elements. The dispersant is one selected from the group consisting of 0.5 to 10% of nitride, boride, carbide and oxide.

The amount of Si is in the range of 10 to 25%. Regarding a hyper-eutectic Al—Si alloy, Si is dispersed as primary crystal and eutectic, so tensile strength and wear resistance improve. When the amount of Si is less than 10%, the Al—Si alloy is hypo-eutectic, and it has $\alpha$ phase+eutectic structure. In this case, tensile strength and wear resistance are not expected. When the amount of Si is more than 25%, Si particle as primary crystal becomes large even if powder metallurgy is used. In this case, the mating member is attacked, and machinability in producing becomes remarkably bad. Furthermore, elongation of the material is very small, and the crack is produced in processing. So, the aluminum alloy in this case is not suitable for practical use.

The amount of Ni is in the range of 5 to 20%. Intermetallic compounds such as $Al_3Ni$ are formed in the aluminum alloy by using Ni. These intermetallic compounds are stable even at high temperature, and they are useful for tensile strength and wear resistance. When the amount of Ni is less than 5%, the intermetallic compounds of Al—Ni is not formed. So, tensile strength and wear resistance cannot be obtained. When the amount of Ni is more than 20%, tensile strength and wear resistance are excellent. On the other hand, machinability deteriorates, so the aluminum alloy in this case is not suitable for practical use.

The amount of Cu is in the range of 1 to 5%. Cu is useful for improving tensile strength of the aluminum alloy. When the amount of Cu is less than 1%, tensile strength is weak. When the amount of Cu is more than 5%, coarse $CuAl_2$ particle is produced, so strength is weak.

The Al—Si alloy as matrix has hyper-eutectic structure because the amount of Si is 10 to 25%. Fine primary Si crystal is formed, so excellent wear resistance is provided. Since the Al—Si alloy also contains 5 to 20% of Ni, the intermetallic compounds such as $Al_3Ni$ or $Al_3Ni_2$ are formed. Therefore, tensile strength and wear resistance improve. Furthermore, tensile strength improves because 1 to 5% of Cu is added. FIG. 7 shows X-ray diffraction result of Al—15Ni—15Si—3Cu, and $Al_3Ni$ and $Al_3Ni_2$ are produced.

The amount of nitride is in the range of 0.5 to 10%. When nitride is dispersed into the matrix, friction coefficient is lowered, and antiseize and wear resistance improve. Furthermore, Al isn't adhered to the mating member, and it can slide easily. When the amount of nitride is less than 0.5%, the above-described effect cannot be obtained. When the amount of nitride is more than 10%, flexural tensile strength and ductility deteriorate. So, desirable amount of nitride is 0.5 to 10%.

The amount of boride is in the range of 0.5 to 10%. When boride is dispersed into the matrix, $B_2O_3$ is produced by oxidation of B because $TiB_2$ is thermodynamically unstable. The melting point of $B_2O_3$ is 450° C. The part of $B_2O_3$ changes to liquid, and finally becomes liquid lubrication. So, friction coefficient of the aluminum alloy is lowered, and antiseize and wear resistance improve. When the amount of boride is less than 0.5%, the above-described effect cannot be obtained. When the amount of boride is more than 10%, mechanical property such as flexural strength and ductility is remarkably lowered. So, desirable amount of boride is 0.5 to 10%.

The amount of carbide or oxide is in the range of 0.5 to 10%. The hardness of carbide or oxide is in the range of Hv1500 to 3000. For example, $Al_2O_3$ is Hv2050, NbO is Hv1900, $SiO_2$ is Hv1700, SiC is Hv2200, $B_4C$ is Hv2350 and VC is Hv2500. When these elements are dispersed into the matrix, wear resistance improves. When the amount of carbide or oxide is less than 0.5%, the above-described effect cannot be obtained. When the amount of carbide or oxide is more than 10%, mechanical property such as flexural strength and ductility is remarkably lowered. So, desirable amount of carbide or oxide is 0.5 to 10%.

The above nitride includes, for example, AlN, TiN, ZrN, $Cr_2N$ and BN. The above boride includes, for example, $TiB_2$, NiB, $MgB_2$ and $ZrB_2$. The above carbide includes, for example, $Cr_3C_2$, $B_4C$, ZrC, SiC and VC. The above oxide includes, for example, $Al_2O_3$, NbO, $SiO_2$, MgO and $Cr_2O_3$. The dispersant is in a form of powders, whiskers and fibers.

The above dispersant is dispersed into the matrix by means of powder metallurgy. At first, the dispersant is mixed within the aluminum alloy powder. Then, the obtained mixed powder is sintered, forged, extruded and rolled. Finally, the mixed powder become solid and compacting is obtained.

Though there is no limit to particle diameter of the dispersant, desirable particle diameter is in the range of 0.2 to 20 μm. When the particle diameter is less than 0.2 μm, the powder is agglomerated, and mechanical characteristics deteriorates. When the particle diameter is more than 20 μm, the particle is cracked or omitted at the time of sliding. Then, abrasive friction occurs, and the effect of wear resistance is weakened.

When nitride is dispersed into the matrix, Al is not adhered to the mating member and it can easily be slided. So, not only low friction coefficient but also antiseize and excellent wear resistance can be obtained. When boride is dispersed into the matrix, $B_2O_3$ having low melting point is produced on the sliding surface. Since boride performs liquid lubrication, low friction coefficient, wear resistance and antiseize improve. When carbide or oxide is dispersed into the matrix, wear resistance improves. This is why carbide or oxide has a hardness of Hv1500 to 3000.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
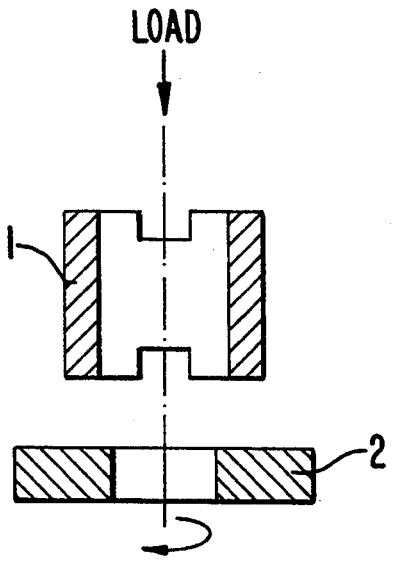
FIG. 1 is a cross sectional view of a test piece and a mating member which are used for friction experiment.

Having generally described the present invention, a further understanding can be obtained by reference to the specific preferred embodiments which are provided herein for purposes of illustration only and are not intended to limit the scope of the appended claims.

The Preferred Embodiments according to the present invention will be hereinafter described with reference to FIGS. 1 through 11.

In the Preferred Embodiment, an alloy containing Al, 15% of Si, 15% of Ni and 3% of Cu was melted and atomized, thereby obtaining an aluminum alloy powder. The aluminum alloy powder was classified by 100 mesh sieve, and −100 mesh powder was obtained. The average particle diameter was $D_{50}=33$ μm. As compared with the above-mentioned aluminum alloy powder, an alloy containing Al, 4.5% of Cu, 1.6% of Mg and 0.5% of Mn (being equivalent to AA 2024) was used, and −100 mesh powder was obtained. Similarly, when an alloy containing Al, 1.0% of Mg, 0.6% of Si and 0.3% of Cu (being equivalent to AA 6061) was used, −100 mesh powder was obtained.

The above aluminum alloy powder was mixed with nitride such as AlN, TiN or ZrN, boride such as $TiB_2$, NiB or $MgB_2$, carbide such as SiCp, SiCw or $B_4Cp$, and oxide such as $Al_2O_3p$ or $B_2O_3p$ in a grinding machine. Concerning nitride, boride, carbide and oxide, the adding amount and the average particle diameter were shown in Table 1.

The mixed powder was filled within a tube made of pure Al. Then a vacuum degassing was performed, and the tube was sealed. After that, the temperature of the tube was heated to 450° C., and the tube having the mixed powder therein was extruded at extrusion ratio of 10. Finally, the extruded material was mechanically processed. Concerning the extruded material, tensile strength, abrasion loss, friction coefficient and seize load were measured. The results were shown in Table 2.

TABLE 1

| | | Alloy Powder | | Dispersant | | | |
|---|---|---|---|---|---|---|---|
| Classification | No. | Component | Average Particle Diameter $D_{50}$ | Component | Average Particle Diameter $D_{50}$ | Dispersed Amount (%) | Notes |
| Present Invention | 1 | Al—15Ni—15Si—3Cu | 33 μm | AlN | 6.8 μm | 2.5 | |
| | 2 | Al—15Ni—15Si—3Cu | 33 μm | AlN | 6.8 μm | 5.0 | |
| | 3 | Al—15Ni—15Si—3Cu | 33 μm | $TiB_2$ | 2.3 μm | 5.0 | |
| | 4 | Al—15Ni—15Si—3Cu | 33 μm | SiCp | 2.6 μm | 5.0 | |
| | 5 | Al—15Ni—15Si—3Cu | 33 μm | SiCw | 2.6 μm | 5.0 | |
| | 6 | Al—15Ni—15Si—3Cu | 33 μm | $Al_2O_3$ | 0.5 μm | 5.0 | |
| | 7 | Al—15Ni—15Si—3Cu | 33 μm | $B_2O_3$ | 11.5 μm | 5.0 | |
| | 8 | Al—15Ni—15Si—3Cu | 33 μm | $B_4Cp$ | 2.1 μm | 5.0 | |
| Comparative Examples | 9 | Al—15Ni—15Si—3Cu | 33 μm | — | — | — | |
| | 10 | Al—4.5Cu—1.6Mg—0.5Mn | 35 μm | SiCp | 2.6 μm | 20.0 | equivalent to 2024 |
| | 11 | Al—1.0Mg—0.6Si—0.3Cu | 38 μm | SiCp | 2.6 μm | 20.0 | equivalent to 6061 |
| Present Invention | 12 | Al—15Ni—15Si—3Cu | 33 μm | TiN | 1.4 μm | 3.0 | |
| | 13 | Al—15Ni—15Si—3Cu | 33 μm | ZrN | 1.3 μm | 3.0 | |
| | 14 | Al—15Ni—15Si—3Cu | 35 μm | NiB | 2.5 μm | 3.0 | |
| | 15 | Al—15Ni—15Si—3Cu | 38 μm | $MgB_2$ | 1.4 μm | 3.0 | |
| | 16 | Al—15Ni—20Si—2.5Cu | 29 μm | AlN | 6.8 μm | 3.0 | |
| | 17 | Al—10Ni—20Si—3Cu | 32 μm | AlN | 6.8 μm | 3.0 | |
| | 18 | Al—5Ni—10Si—2.8Cu | 36 μm | AlN | 6.8 μm | 3.0 | |
| Comparative Examples | 19 | Al—15Ni—20Si—2.5Cu | 29 μm | — | — | — | no dispersant |
| | 20 | Al—10Ni—20Si—3Cu | 32 μm | — | — | — | no dispersant |

TABLE 2

| | | Tensile Strength (MPa) | | Friction Experiment by Testing Machine | | Abrasion Loss (μm) by LFW Friction | |
|---|---|---|---|---|---|---|---|
| Classification | No. | Room Temperature | 200° C. | Friction Coefficient | Seize Load(N) | Experiment | Notes |
| Present Invention | 1 | 520 | 450 | 0.35 | 1500 | 2 | |
| | 2 | 450 | 420 | 0.33 | 1750 | 3 | |
| | 3 | 500 | 450 | 0.37 | 1500 | 25 | |
| | 4 | 500 | 450 | 0.45 | 1000 | 30 | |
| | 5 | 550 | 490 | 0.48 | 1000 | 32 | |
| | 6 | 480 | 430 | 0.50 | 750 | 35 | |
| | 7 | 480 | 430 | 0.38 | 1500 | 25 | |
| | 8 | 470 | 430 | 0.36 | 1500 | 23 | |
| Comparative Examples | 9 | 550 | 440 | 0.48 | 1000 | 43 | no dispersant |
| | 10 | 450 | 170 | 0.53 | 1000 | 45 | equivalent to 2024 |
| | 11 | 520 | 210 | 0.58 | 750 | 48 | equivalent to 6061 |
| Present Invention | 12 | 510 | 430 | 0.32 | 1750 | 20 | |
| | 13 | 500 | 420 | 0.36 | 1500 | 32 | |
| | 14 | 520 | 430 | 0.35 | 1250 | 26 | |
| | 15 | 490 | 400 | 0.32 | 1250 | 27 | |
| | 16 | 535 | 411 | — | — | 5 | |
| | 17 | 448 | 363 | — | — | 3 | |
| | 18 | 505 | 295 | — | — | 9 | |
| Comparative Examples | 19 | 569 | 430 | — | — | 45 | no dispersant |
| | 20 | 477 | 385 | — | — | 65 | no dispersant |

Figure 2:
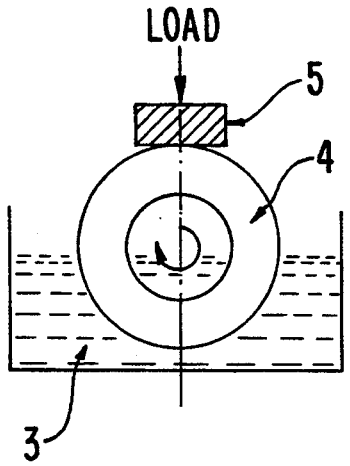
FIG. 2 is a cross sectional view for showing friction experiment.

The friction coefficient and seize load were measured by a testing machine as shown in FIG. 1. A ring-shaped member 1, JIS SUJ2, was pressed against a box-shaped test piece 2 under the condition that a load was increased by 250(N) and a sliding speed was 13 m/min. Then, friction coefficient and seize load were measured under a drying condition. The abrasion loss was measured by LFW testing machine as shown in FIG. 2. A ring-shaped member 4, JIS SUJ2, was immersed into oil 3. Then, a box-shaped test piece 5 was pressed against the ring-shaped member 4 under the condition that the load was 150(N) and the sliding speed was 18 m/min. After being pressed for 15 minutes, abrasion loss was measured.

Concerning comparative examples 9, 19 and 20 in Table 2, a matrix comprised the aluminum alloy only, and the dispersant wasn't dispersed. These comparative examples 9, 19 and 20 showed excellent tensile strength, and the values of tensile strength were in the range of 385 to 440 MPa at 200° C. But the comparative example 9 showed rather high friction coefficient, and the value of friction coefficient was 0.48. According to friction coefficient, the value of seize load was about 1000(N). Since the dispersant wasn't dispersed, the values of abrasion loss were in the range of 43 to 65 μm. The comparative examples 9, 19 and 20 showed poor wear resistance.

Concerning comparative example 10, the composition of the matrix was AA 2024, and SiC was dispersed in more amount than that was needed. The comparative example 10 showed poor tensile strength, and the tensile strength at 200° C. was 170 MPa. Moreover, the comparative example 10 showed rather high friction coefficient, and the value of friction coefficient was 0.53. According to friction coefficient, the value of seize load was 1000(N). Furthermore, the value of abrasion loss was 45 μm. The comparative example 10 showed poor tensile strength, poor antiseize, and poor wear resistance.

Concerning comparative example 11, the composition of the matrix was AA 6061, and SiC was dispersed in more amount than that was needed. The comparative example 11 showed poor tensile strength, and the tensile strength at 200° C. was 210 MPa. Moreover, the comparative example 11 showed rather high friction coefficient, and the value of friction coefficient was 0.58. According to friction coefficient, the value of seize load was 750(N). Furthermore, the value of abrasion loss was 48 μm. The comparative example 11 showed poor tensile strength, poor antiseize, and poor wear resistance.

On the contrary, examples 1 to 8 and 12 to 15 showed excellent tensile strength, excellent antiseize, and excellent wear resistance. The examples 1 to 8 and 12 to 15 showed excellent tensile strength, and the tensile strength at 200° C. were in the range of 400 to 520 MPs. The examples 4 to 6 in which SiC and $Al_2O_3$ were dispersed showed a little bit higher friction coefficient and lower seize load. However, the examples 1 to 3, 7 and 8 showed lower friction coefficient and excellent seize load, and the values of friction coefficient were in the range of 0.35 to 0.38, and the values of seize load were in the range of 1500 to 1750(N). The examples 1 and 2 in which AlN was dispersed showed very excellent abrasion loss, and the values of abrasion loss were in the range of 2 to 3 μm. Similarly, as for the examples 16 to 18, the values of abrasion loss were in the range of 3 to 9 μm, although examples 17 and 18 showed reduced tensile strengths at 200° C. Moreover, the examples 3 to 8 also showed excellent abrasion loss, and the values of abrasion loss were in the range of 23 to 35 μm. Especially, the examples 12 to 15 in which nitride and boride are dispersed showed more excellent wear resistance as compared with examples in which oxide and carbide are dispersed.

Figure 3:
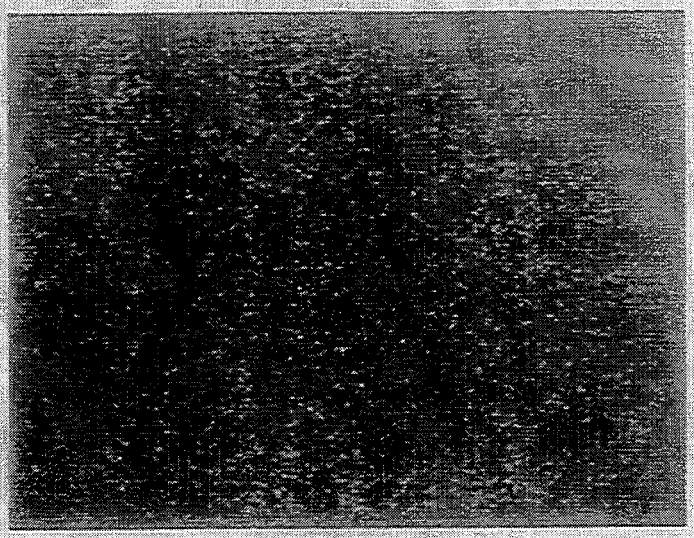
FIG. 3 is an EPMA photograph (magnification×1000) for showing Al distribution on the surface of the mating member when LFW experiment is performed on the example of the present invention in which AlN is dispersed .
Figure 4:
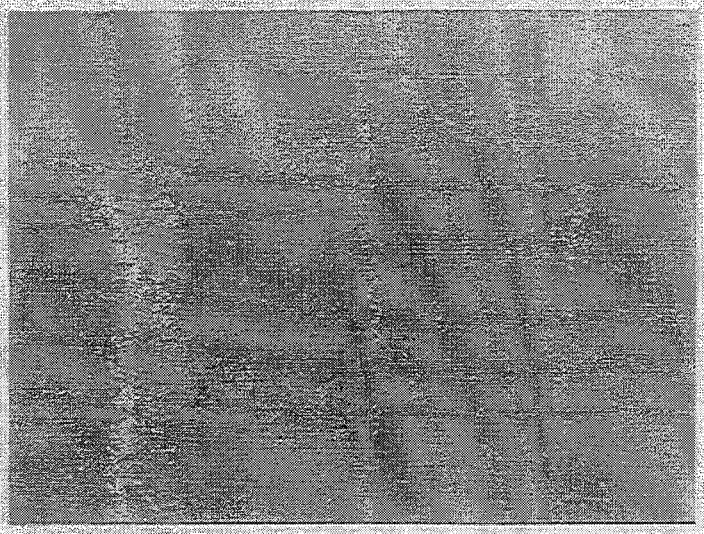
FIG. 4 is an EPMA photograph (magnification×1000) for showing Al distribution on the surface of the mating member when LFW experiment is performed on the comparative example in which AlN is not dispersed.

FIG. 3 is an EPMA photograph (magnification×1000) for showing Al distribution on the surface of the ring-shaped member when LFW experiment is performed on the example 1 of the present invention in which AlN is dispersed. According to FIG. 3, Al is hardly adhered to the ring-shaped member. On the contrary, FIG. 4 shows that Al is adhered to the ring-shaped member and agglutination abrasion is occured. FIG. 4 is an EPMA photograph (magnification×1000) for showing Al distribution on the surface of the ring-shaped member when LFW experiment is performed on the comparative example 9 in which AlN is not dispersed.

Figure 5:
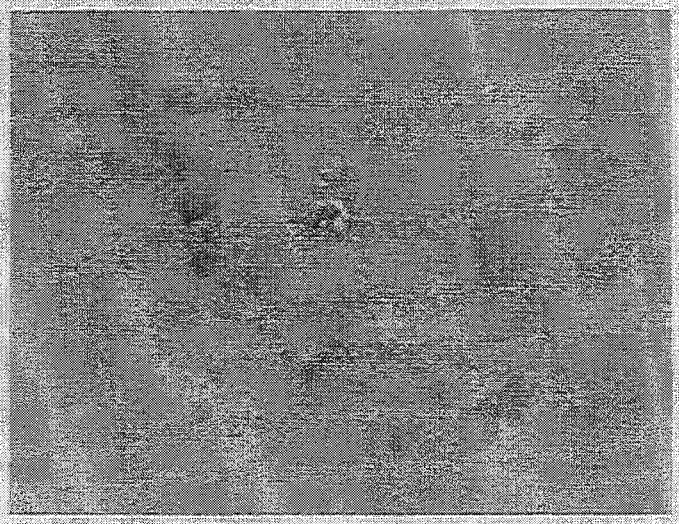
FIG. 5 is a SEM photograph (magnification×1000) after LFW experiment is performed on the example of the present invention in which AlN is dispersed.
Figure 6:
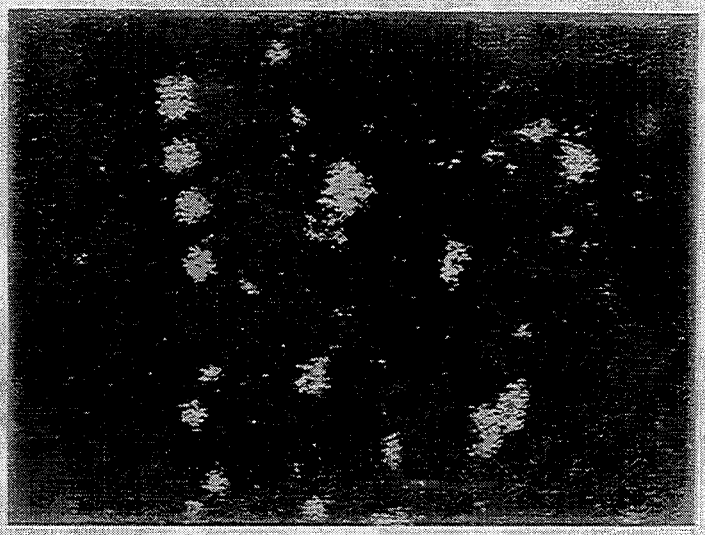
FIG. 6 is an EPMA photograph (magnification×1000) for showing N distribution when LFW experiment is performed on the example of the present invention in which AlN is dispersed.
Figure 7:
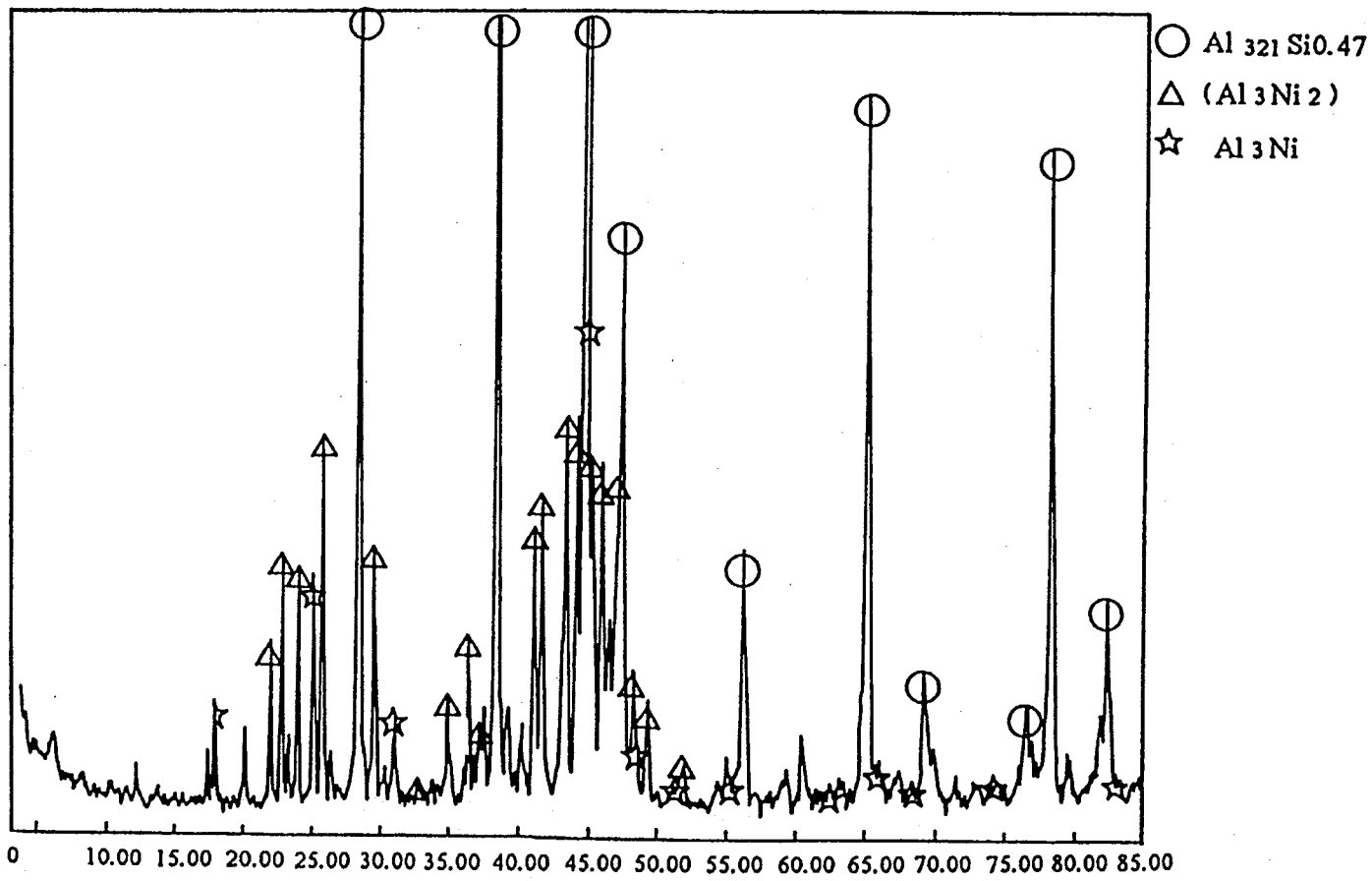
FIG. 7 shows X-ray diffraction result of Al—15Ni—15Si—3Cu.

FIG. 5 is a SEM photograph (magnification×1000) after LFW experiment is performed on the example 1 of the present invention in which AlN is dispersed. FIG. 6 is an EPMA photograph (magnification×1000) for showing N distribution after LFW experiment is performed on the example 1 of the present invention in which AlN is dispersed. As is obvious from FIGS. 5 and 6, it is confirmed that AlN particle is held in the matrix after LFW experiment is performed. It is also confirmed that no AlN particle is omitted.

Figure 8A:
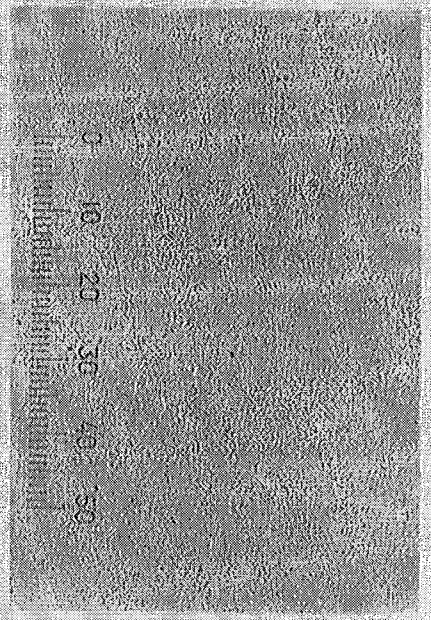
FIGS. 8(*a*), and 8(*b*) are optical micrographs (magnification×100 and 400) for showing the metal structure of the comparative example 9.
Figure 8B:
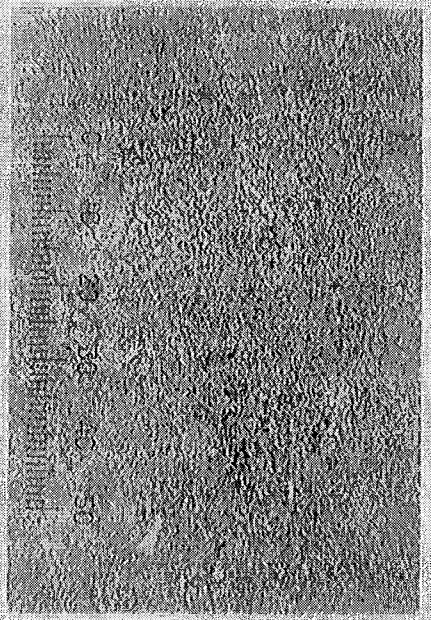
Figure 9A:
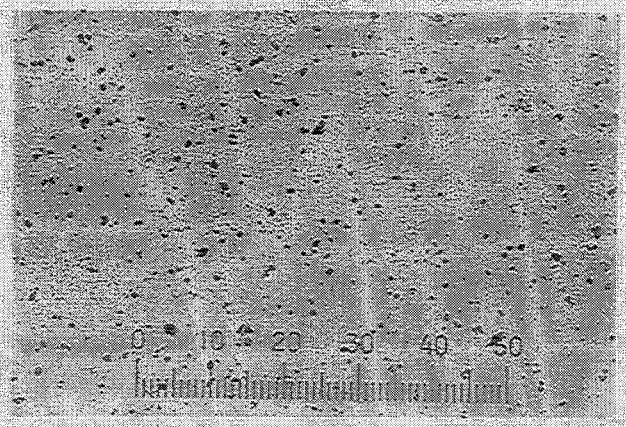
FIGS. 9(*a*) and 9(*b*) are optical micrographs (magnification×100 and 400) for showing the metal structure of the example 1 of the present invention.
Figure 9B:
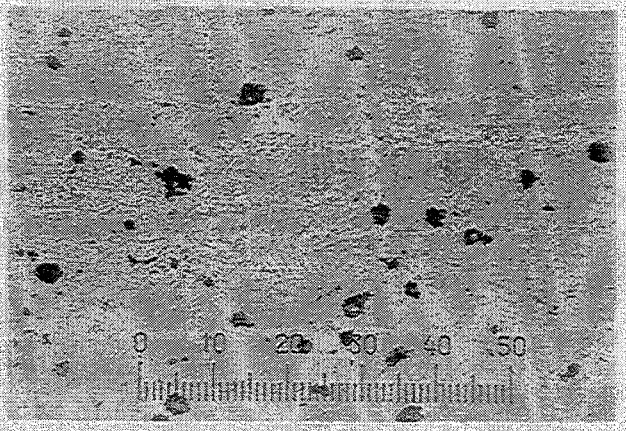
Figure 10A:
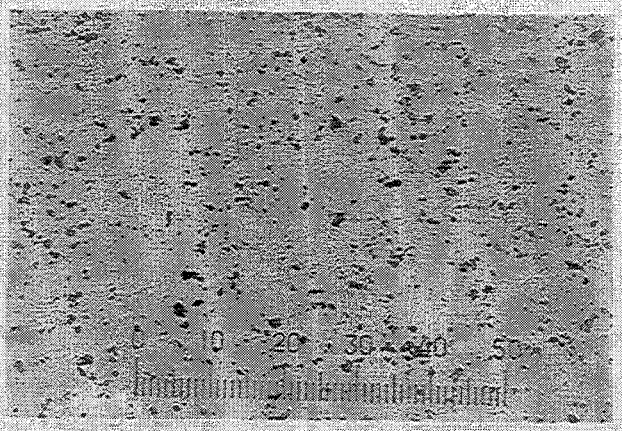
FIGS. 10(*a*) and 10(*b*) are optical micrographs (magnification×100 and 400) for showing the metal structure of the example 2 of the present invention.
Figure 10B:
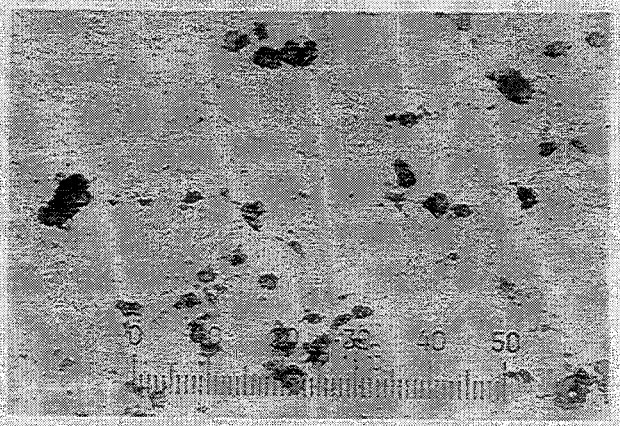
Figure 11:
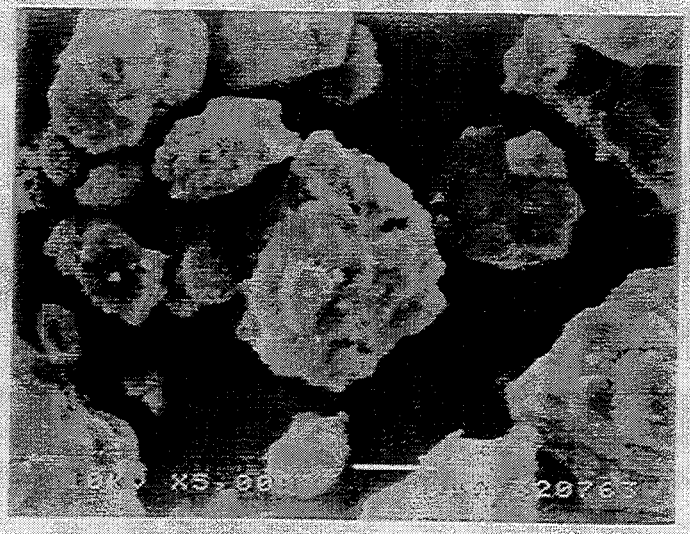
FIG. 11 is a SEM photograph (magnification×5000) for showing the appearance of the dispersed AlN particle in the preferred embodiments.

FIG. 8 (*a*) and (*b*) are optical micrographs (magnification×100 and 400) for showing the metal structure of the comparative example 9. FIG. 9 (*a*) and (*b*) are optical micrographs (magnification×100 and 400) for showing the metal structure of the example 1. FIG. 10 (*a*) and (*b*) are optical micrographs (magnification×100 and 400) for showing the metal structure of the example 2. As is obvious from these optical micrographs, in the examples 1 and 2, it is confirmed that AlN particle is held in the matrix after LFW experiment is performed. It is also confirmed that no AlN particle is omitted. FIG. 11 is a SEM photograph (magnification×5000) for showing the appearance of the dispersed AlN particle in the preferred embodiments.

As above-described, the present invention completed an aluminum alloy which shows excellent tensile strength and excellent wear resistance. The aluminum alloy consists essentially of 90 to 99.5% by weight of matrix and 0.5 to by weight of a dispersant dispersed within the matrix. The matrix comprises 10 to 25% by weight of Si, 5 to 20% by weight of Ni, 1 to 5% by weight of Cu and the rest of Al and impurity elements. The dispersant is one selected from the group consisting of 0.5 to 10% of nitride, boride, carbide and oxide. The Al—Si alloy as matrix has hyper-eutectic structure because the amount of Si is 10 to 25%. Excellent wear resistance is provided by fine primary Si crystal. Since the Al—Si alloy also contains 5 to 20%.of Ni, intermetallic compounds such as $Al_3Ni$ or $Al_3Ni_2$ are formed. Therefore, tensile strength and wear resistance improve. Furthermore, tensile strength improves because 1 to 5% of Cu is added.

When nitride is dispersed into the matrix, Al is not adhered to the ring-shaped member and it can easily slide. So, not only low friction coefficient but also antiseize and excellent wear resistance can be obtained. When boride is dispersed into the matrix, liquid phase $B_2O_3$ having low melting point is produced on the sliding surface. Since boride performs liquid lubrication, low friction coefficient, wear resistance and antiseize improve. When carbide or oxide is dispersed into the matrix, wear resistance improves. This is why carbide or oxide has a very high hardness of Hv1500 to 3000.

As the result, the obtained aluminum alloy member can be applied to engine parts, an intake valve, a piston, or the like. This achieves light weight of these elements. The aluminum alloy shows high-heat conductivity and it is excellent in its tensile strength and wear resistance. Therefore, the aluminum alloy is suitable for the intake valve, and it is applied to the piston of high power engine. Furthermore, the aluminum alloy is also applied to cylinder liner since it is excellent in its wear resistance and antiseize. Moreover, when the aluminum alloy is applied to a valve retainer or a spring retainer, this achieves light weight of their elements.

What is claimed is:

1. An aluminum alloy consisting essentially of 90 to 99.5% by weight of matrix and 0.5 to 10% by weight of a dispersant dispersed within said matrix, said matrix comprising 10 to 25% by weight of Si, 10 to 20% by weight of Ni, 1 to 5% by weight of Cu and the rest of Al and impurity elements, said dispersant being at least one selected from the group consisting of 0.5 to 10% of nitride, boride, carbide and oxide.

2. An aluminum alloy according to claim 1, wherein said nitride is AlN, TiN, ZrN, $Cr_2N$ or BN.

3. An aluminum alloy according to claim 1, wherein said boride is $TiB_2$, NiB, $MgB_2$ or $ZrB_2$.

4. An aluminum alloy according to claim 1, wherein said carbide is $Cr_3C_2$, $B_4C$, ZrC, SiC or VC.

5. An aluminum alloy according to claim 1, wherein said oxide is $Al_2O_3$, NbO, $SiO_2$, MgO or $Cr_2O_3$.

6. An aluminum alloy according to claim 1, wherein said dispersant is in a form of powders, whiskers or fibers.

7. An aluminum alloy according to claim 1, wherein said dispersant is in a form of powders of which the diameter is in the range of 0.2 to 20 μm.

8. An aluminum alloy according to claim 1, wherein said dispersant is dispersed into the matrix by means of powder metallurgy.

9. An aluminum alloy according to claim 1, wherein the tensile strength at 200° C. is in the range of 400 to 490 MPa.

10. An aluminum alloy consisting essentially of 90 to 99.5% by weight of matrix and 0.5 to 10% by weight of dispersant particles dispersed within said matrix, said matrix consisting of 10 to 25% by weight of Si, from more than 10% to 20% by weight of Ni, 1 to 5% by weight of Cu and the rest of Al and impurity elements, said dispersant being at least one selected from the group consisting of nitride, boride, carbide and oxide particles, and wherein intermetallic compounds of Al and Ni are formed in said alloy.

11. The aluminum alloy of claim 10 wherein the Ni content of said matrix is from 15% to 20% by weight.

* * * * *